United States Patent [19]

Koch et al.

[11] Patent Number: 4,563,243

[45] Date of Patent: Jan. 7, 1986

[54] APPARATUS AND A METHOD FOR PRODUCING WOOD PULP IN A HOLLOW CYLINDER CONTAINING A ROTATABLE SCREW

[75] Inventors: Klaus Koch, Laatzen; Gerhard Syrbius, Grossburgwedel, both of Fed. Rep. of Germany

[73] Assignee: Hermann Berstorff Maschinenbau GmbH, Hanover, Fed. Rep. of Germany

[21] Appl. No.: 624,195

[22] Filed: Jun. 25, 1984

[30] Foreign Application Priority Data

Jun. 25, 1983 [DE] Fed. Rep. of Germany ..... 3322924

[51] Int. Cl.[4] ..... D21B 1/16

[52] U.S. Cl. ..... 162/18; 162/19; 162/23; 162/24; 162/26; 162/28; 162/261; 241/28; 241/246; 241/260.1

[58] Field of Search ..... 162/18, 19, 52, 20, 162/24, 25, 26, 28, 236, 246, 261; 241/245, 246, 247, 260.1, 261, 15, 28

[56] References Cited

U.S. PATENT DOCUMENTS

| | | | |
|---|---|---|---|
| 2,673,690 | 3/1954 | Segl | 162/18 |
| 2,829,049 | 4/1958 | Segl | 162/18 |
| 3,305,183 | 2/1967 | Morden | 241/260.1 |
| 3,547,356 | 2/1967 | Asplund | 241/28 |
| 4,088,528 | 5/1978 | Berger et al. | 162/19 |
| 4,136,207 | 1/1979 | Bender | 162/18 |
| 4,295,925 | 10/1981 | Bentvelzen et al. | 162/19 |

FOREIGN PATENT DOCUMENTS

| | | | |
|---|---|---|---|
| 1087420 | 10/1967 | United Kingdom | 241/246 |

*Primary Examiner*—Steve Alvo

*Attorney, Agent, or Firm*—Schwartz, Jeffery, Schwaab, Mack, Blumenthal & Evans

[57] ABSTRACT

An apparatus for continuously producing wood pulp from wood shavings comprising a screw which rotates within a hollow cylinder. The hollow interior of the cylinder is divided into a pressure zone and a grinding and bleaching zone, the shavings being subjected to at least partially defibrillation under a high, continuously-increasing pressure in the pressure zone and then being simultaneously further defibrillated and bleached in the grinding and bleaching zone. The grinding and bleaching zone includes a plurality of pin planes, each plane being formed of at least three radially extending pins which project through the wall of the cylinder, the planes being spaced apart along the length of the screw. The pin planes provide a further pressure increase and produce a desired grinding and defibrillation effect, so that wood pulp is produced without damaging the material and a bleaching agent is simultaneously injected into the grinding and bleaching zone, is caused to be distributed thoroughly and uniformly through the fibers.

A method for producing wood pulp in a screw press comprising the steps of feeding the shavings into the hollow interior of the cylinder which is divided into two zones, rotating the screw while at least minimizing the rotation of the shavings with the screw to cause the shavings to traverse the first zone so that the pressure acting on the shavings builds up and at least partial defibrillation of the shavings occurs, the shavings then entering the second zone in which they are simultaneously ground and bleached, the grinding being effected by pressing the shavings, by the rotation of the screw, against radially extending pins projecting through the cylinder to the base of the screw, the pins being located in a plurality of pin planes extending transversely to the longitudinal axis of the screw and at least three pins being provided in each plane and the bleaching being effected by injecting a bleaching or other treatment agent into the cylinder in the grinding and bleaching zone, and finally discharging the thus produced wood pulp from the cylinder.

17 Claims, 4 Drawing Figures

Fig.2
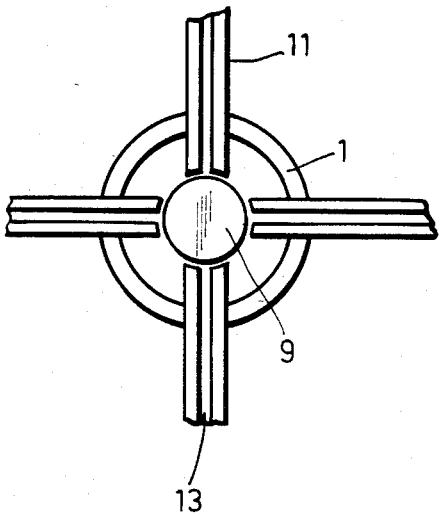
Fig.3
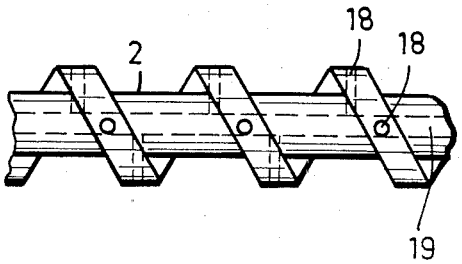
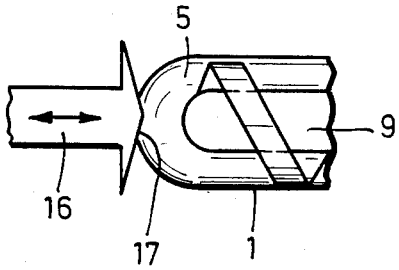
Fig.4

APPARATUS AND A METHOD FOR PRODUCING WOOD PULP IN A HOLLOW CYLINDER CONTAINING A ROTATABLE SCREW

FIELD OF THE INVENTION

The invention relates to an apparatus and a method for producing wood pulp, and more particularly to an apparatus and method in which damped or steam-treated wood shavings are treated in a screw-conveyor.

BACKGROUND OF THE INVENTION AND DISCUSSION OF PRIOR ART

German Auslegeschrift No. 2 901 943 describes a method of producing wood pulp in which wood is hot-ground on a grindstone utilising a hot liquid having a boiling point in excess of 100° C. at atmospheric pressure. The method is highly uneconomical and has a high energy consumption.

German Offenlegunngsschrift No. 1 811 187 describes another method and a device whereby wooden slats are fed to a rotating grindstone from both sides. Such a grinder is more efficient because twice the amount of wood pulp is produced.

In addition, so-called continuous grinders for producing wood pulp are known and one such arrangement is disclosed in German Auslegeschrift No. 1 461 009 which permit amounts of wood to be continuously supplied to a rotating grindstone through a pressure-actuated chute. The object of such a grinder is to standardise the downward pressure so that wood fibres of uniform size are produced.

OBJECTS OF THE PRESENT INVENTION

The invention seeks to provide an apparatus and a method which will enable wood pulp to be produced economically whilst achieving a high output or production rate.

The present invention also seeks to provide an apparatus and a method which can be operated continuously and in which careful defibrillation of the shavings is achieved whilst still ensuring that bleaching agents or the like, which are used in the preparation of the pulp, are distributed uniformly through the fibres.

SUMMARY OF THE INVENTION

According to the present invention, there is provided an apparatus for producing wood pulp, comprising a hollow cylinder having a driven rotatable conveyor screw disposed therein, the screw having helical flights disposed thereon, a material feed hopper disposed at one end of the hollow cylinder through which damped or steam-treated wood shavings are fed into the cylinder and a material outlet formed at the other end of the cylinder from which the wood pulp is discharged wherein the hollow cylinder comprises a pressure zone adjacent the feed hopper and a grinding and bleaching zone adjacent the outlet, grooves being provided in the internal surface of the cylinder in the pressure zone and injection nozzles for injecting bleaching or other treatment agents are provided in the grinding and bleaching zone, stationary, radially extending pins which project into the interior of the cylinder to adjacent the base or core of the screw being provided in the grinding and bleaching zone, the flights of the screw being interrupted in the region of the pins to accommodate the pins, the pins being combined to form a plurality of pin planes extending transversely to the longitudinal axis of the screw, each pin plane containing at least three pins.

The apparatus for producing wood pulp is divided into two zones. In the first zone a high pressure is exerted upon the wood which, at this time, is in the form of shavings. The passage of the shavings into the apparatus is assisted by axial or helical grooves provided in the internal surface of the hollow cylinder.

Heat, in the form of pressurised steam, is produced by the internal friction or shearing of the shavings in the screw threads. This softens the shavings or, more accurately, the lignin in the shavings and promotes defibrillation. Both the screw and the cylinder are advantageously provided with tempering bores so as to permit the temperature of the shavings in the zone to be adjusted appropriately.

The speed of conveyance of the shavings is retarded by providing longitudinally extending grooves on the internal wall of the cylinder. The shavings are caused to rotate in the screws threads, thereby causing defibrillation. In view of the above-mentioned build-up of pressure and the intense shearing, that is, the heating of the shavings in the screw threads, the shavings are subjected to considerable mechanical action, so that they are well prepared for the production of wood pulp when they enter the second zone, i.e. the grinding and bleaching zone, in which the wood pulp is produced.

Radially extending stationary pins are disposed in the grinding and bleaching zone in pin planes extending transversely to the longitudinal axis of the screw. The shavings are pressed against the pins as a result of the screw rotation.

Due to the rotation of the screw, and the pressing of the material which is already being subjected to a high pressure, fine defibrillation is effected and an additional increase in pressure is simultaneously achieved.

In the centre of the first or pressure zone, pressures of between 20 and 300 bars are produced whereas the pressure may increase to 500 bars in the grinding and bleaching zone in which the wood pulp is produced.

By combining the pins into pin planes, the delivery output of the apparatus is considerably increased because this augments the prevention of the prefibrillated material from rotating with the screw. In turn, an increase in the delivery output automatically results in a considerable increase in pressure inside the cylinder which, in turn, further advantageously affects the production of wood pulp.

Once the material has passed the pin planes, the proportion of high-quality wood pulp in the total quantity of pulp is already considerable. The more pin planes that are provided and are passed by the material the greater is the proportion of wood pulp produced. Thus, for example, acceptable results were achieved using only two pin planes. However, if ten pin planes are utilised, the product produced is extremely well defibrillated which has only an extremely small proportion of relatively large fragments. It is, in fact, surprising to find that the proportion of long and very fine fibres in the pulp is very high and that the fibres had been separated from the composite material in the shavings in an almost undamaged state. The wood pulp contained few fibre fragments and relatively few fibre bundles or chippings. In addition, the proportion of long fibres is high, thereby permitting relatively gentle treatment in the grinding and bleaching zone.

The injection nozzles advantageously comprise axial bores formed in the pins, which bores are connected to a conduit system so as to permit the injection of bleaching agent, such as a peroxide, into the interior chamber of the cylinder in a uniform manner and at a plurality of locations simultaneously. In such a case, it has proved desirable to ensure that the spacing between the radially inner ends of the pins and the base or core of the screw thread is small, for example, between 0.1 and 1.5 mm. This prevents the nozzle bores from becoming blocked.

It is also possible to inject bleaching agents or other necessary chemicals into the cylinder chamber by providing the screw flights with a plurality of radially extending bores in the longitudinal direction of the screw in the bleaching and grinding zone, which radially extending bores are connected to a longitudinal bore formed in the core of the screw.

However, when a liquid is injected into the longitudinal bore in the screw, it emerges from all of the radial bores in the flights simultaneously, thereby ensuring uniformity in the treatment of the wood pulp.

The bleaching agents may also be injected through nozzles which terminate flush with the internal wall of the cylinder. In such a case, the injection pressure must, of course, exceed the pressure prevailing in the hollow interior cylinder.

In order to achieve good feeding of the shavings into the cylinder, it is advantageous if the feed hoppers have a ramming or packing mechanism associated therewith whereby the shavings are pressed into the screw threads, which latter are deep in the feed region, so that the screw threads are maintained full and a uniform feed of the shavings into the apparatus is ensured. By ensuring that the feed is uniform, it is ensured that the discharge of the pulp from the apparatus is also uniform.

The material outlet may advantageously be provided with a closure device which builds up a back-pressure in the cylinder but which opens at a preselected pressure, so as to influence the pressure in the downstream end region of the grinding and bleaching zone.

Also in accordance with the present invention, there is provided a method for producing wood pulp from wood shavings in a single screw press comprising the steps of feeding damped or steam-treated wood shavings into the cylinder of the press, rotating the screw to cause the shavings to be conveyed through a first treatment zone whilst at least minimizing the rotation of the shavings with the screw whereby the pressure acting on the shavings is substantially increased and at least partial defibrillation of the shavings occurs, the further rotation of the screw conveying the partially defibrillated shavings into a second treatment zone, simultaneously grinding and bleaching the at least partially defibrillated shavings in the second zone by, respectively, further rotating the screw so that the shavings are pressed against a plurality of radially extending pins projecting through the cylinder to adjacent the core of the screw, the pins being disposed in a plurality of pin planes extending transversely to the axis of the screw and at least three pins being provided in each plane and by injecting a bleaching agent into the second zone of the cylinder and finally discharging the pulp thus produced from the cylinder.

BRIEF DESCRIPTION OF THE DRAWINGS

The invention will be further described, by way of example, with reference to the accompanying drawings, in which:

FIG. 2 is a cross-sectional view taken along the line II—II of FIG. 1.

FIG. 3 is a partial, longitudinal sectional view through part of a screw forming part of the apparatus shown in FIGS. 1 and 2, and FIG. 4 is a longitudinal sectional view through a closure device for closing the material discharge end of an apparatus shown in FIGS. 1 to 3.

DESCRIPTION OF PREFERRED EMBODIMENTS

Figure 1:
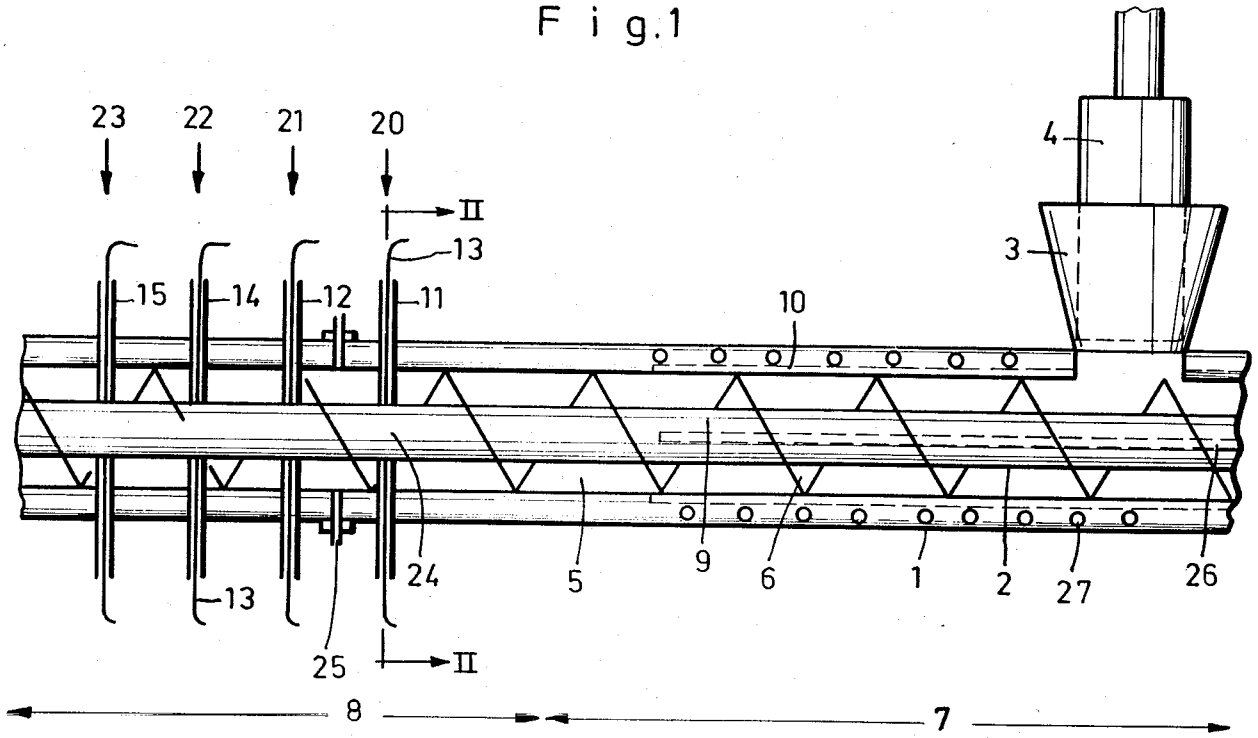
FIG. 1 is a partial, longitudinal sectional view through an apparatus in accordance with the present invention.

Referring firstly to FIG. 1, there is shown an apparatus in accordance with the present invention which comprises a hollow barrel or cylinder 1 in which a rotatable screw 2 is disposed. From a feed hopper 3, wood shavings are forced into the hollow interior 5 of the cylinder 1 either directly or between the flights 6 on the screw 2 by means of the ramming or packing mechanism 4. The mechanism 4 may be either hydraulically or pneumatically operated.

The screw 2 is rotated by means of a drive unit (not shown) and conveys the wood shavings into a zone 7 of the hollow interior 5 of the cylinder 1 in which a build-up of pressure occurs. Also within the interior 5 of the cylinder 1, but downstream of the zone 7 in the direction of material travel is a grinding and bleaching zone 8 in which the shavings are converted into wood pulp.

The hollow cylinder 1 is provided, on its internal wall, with axially extending longitudinal grooves 10 in the zone 7 which prevent, or at least minimise, the rotation of the contents of the cylinder with the screw. In consequence, there is a considerable build-up of pressure within the zone 7 which acts on the material being treated.

Pins 11, 12, 14 and 15 are disposed in the grinding and bleaching zone 8, which pins 11 protrude radially inwardly through the wall of the cylinder 1 and terminate substantially at the base of the core of the screw 2. The flights 6 of the screw 2 are interrupted, as shown at 24, in the regions where the pins 11, 12, 14 and 15 protrude into the cylinder 1.

Bores 13 are provided in the pins 11, 12, 14, 15 so as to permit the injection of a bleaching fluid or the like into the interior 5 of the cylinder 2. Tempering bores 26 and 27, formed in the screw 2 and hollow cylinder 1 respectively, permit an appropriate temperature conduction to be achieved.

A material outlet or discharge aperture 17 is formed at the downstream end of the zone 8. This aperture is sealed by means of an hydraulically-operated closure device 16, shown in FIG. 4. This device is intended to remain in position until a preselected pressure prevails in the zone 8, whereupon the device 16 opens by moving in the direction of the arrow shown in FIG. 4.

An additional way in which liquids may be injected into the cylinder chamber 5 is illustrated in FIG. 3. As can be seen in this Figure, the core of the screw 2 has an axially extending longitudinal bore 19 formed therein. The bore 19 communicates with radially extending bores 18 formed in the flights of the screw. The liquid is thus caused to enter the bore 19 from which it flows into the bores 18 and thence into the interior 5 of the cylinder 2.

As best seen in FIGS. 1 and 2, the pins 11, 12, 14 and 15, which are stationary may be disposed in pin planes 20, 21, 22 and 23. In such a case, there will be a plurality, for example four, of pins in each pin plane. In practical terms, the radially inward ends of the pins terminate between 0.1 and 1.5 mm from the base of the core of the screw 2. The pin planes 20, 21, 22 and 23 are, as shown in FIG. 1, located in the grinding and bleaching zone 8.

In the zone 7, there is a considerable build-up of pressure, the pressure increasing in the direction of the grinding and bleaching zone 8. The zone 8 as explained in detail hereinbefore, contains high-quality wood pulp having a bleaching agent very evenly distributed therein. It should be emphasized, however, that such evenness of distribution of the bleaching agent can still be effected very rapidly because of the high pressure and the pressure causes the bleaching agent to penetrate even finest threads of the fibres.

We claim:

1. Apparatus for producing wood pulp from moisture-containing cellulosic material comprising:

(a) a hollow cylinder having first and second ends, the interior wall of said cylinder defining in a first portion thereof a pressure zone terminating adjacent said first end and extending toward said second end, and in a second portion thereof a grinding and bleaching zone downstream of said pressure zone and in which higher pressures are created, groove means formed in the inner wall of said cylinder in said pressure zone for inhibiting rotation of the material with said screw in said pressure zone, thereby causing a pressure build up in said pressure zone, said groove means terminating before said second end of the hollow cylinder;

(b) a single rotatable screw mounted for rotation in said cylinder through both of said zones, said screw having a core and helical flights disposed around said core;

(c) material feed means mounted adjacent said first end of said cylinder and through which material can be fed into the pressure zone of said cylinder;

(d) material discharge means at the second end of said cylinder and communicating with said grinding and bleaching zone for controlling the discharge of treated material from the cylinder;

(e) radially extending stationary pins projecting into the grinding and bleaching zone of said cylinder and terminating adjacent said core, said pins being situated in longitudinally spaced pin planes each of which contains at least three arcuately spaced pins, said helical flights being interrupted in the planes of said pins to accommodate the same during rotation of said screw, said stationary pins being engaged by said material as a result of rotation of said screw, thereby achieving a further increase in pressure in said grinding and bleaching zone, and (f) means for injecting bleaching or other treatment agents into the grinding and bleaching zone, whereby partial defibrillation of the material is effected under pressure in said pressure zone, and fine defibrillation is effected in said grinding and bleaching zone due to the relatively higher pressure therein created by said pins and the injection of bleaching or other treatment agents into said bleaching zone.

2. An apparatus as recited in claim 1, wherein said injecting means comprises bores formed in said pins, said bores forming nozzles to which a source of hydraulic pressure can be connected for injection at a pressure higher than the pressure in said bleaching zone.

3. An aparatus as recited in claim 1, wherein said flights of said screw in said grinding and bleaching zone are formed with a plurality of radially extending bores communicating with said zone, each said radially extending bore thus forming a nozzle and comprising said injection means, and wherein a longitudinally extending bore is formed in the core of the screw, each said radially extending bore communicating with said longitudinally extending bore.

4. An apparatus as recited in claim 1, wherein said injection means comprises injection nozzles terminating flush with the inner wall of said cylinder and communicating with said bleaching zone.

5. An apparatus as recited in claim 1, wherein said groove means formed in the inner wall of said cylinder comprises axially extending grooves for increasing the pressure in said zone.

6. An apparatus as recited in claim 1, wherein said groove means formed in the inner wall of said cylinder comprises spaced helical grooves in said pressure zone for increasing the pressure in said zone.

7. An apparatus as recited in claim 1, further including ramming means associated with said material feed hopper to assist in feeding said material into said hollow interior of said cylinder.

8. An apparatus as claimed in claim 1, further including pressure biased closure means for sealing said second end of said cylinder to assist in the build-up of pressure within said cylinder, said closure means being movable out of sealing engagement with said second end of said cylinder when a predetermined pressure prevails in said cylinder.

9. An apparatus as claimed in claim 1, wherein the radially inner ends of said pins are spaced from the core of said screw a distance in the range of between 0.1 and 1.5 mm.

10. An apparatus as recited in claim 1, further including temperature control means associated with said screw in said pressure zone for controlling the temperature of said screw in said zone.

11. An apparatus as recited in claim 1, further including temperature control means associated with said cylinder in said pressure zone for controlling the temperature of said cylinder in said zone.

12. A method for producing pulp from moisture-containing cellulosic material in a screw press, said screw press comprising a hollow cylinder having first and second ends, a single rotatable screw having helical flights disposed within said hollow cylinder between said ends, a material feed inlet disposed in said first end of said cylinder and a wood pulp discharge outlet disposed in said second end, said hollow cylinder defining a pressure zone adjacent said feed inlet and a grinding and bleaching zone adjacent said discharge outlet and downstream of said pressure zone, grooves formed in the inner wall of said cylinder in said pressure zone, and a plurality of stationary radially extending pins projecting into said hollow cylinder in said grinding and bleaching zone, comprising the steps of:

(a) introducing said cellulosic material into said pressure zone through said material feed inlet;

(b) applying pressure to said material in said pressure zone by rotating said screw and inhibiting by said grooves the rotation of the material relative to said screw to cause partial defibrillation of said material;

(c) conveying said partially defibrillated material into said grinding and bleaching zone;

(d) further defibrillating said material in said grinding and bleaching zone by further rotating said screw so that said material is pressed against said pins thereby increasing the pressure in said grinding and bleaching zone;

(e) injecting bleaching or other treatment agents into said grinding and bleaching zone to enhance further defibrillation and produce wood pulp; and (f) discharging said pulp through said discharge outlet.

13. A method as recited in claim 1, wherein said step of injecting is accomplished by injecting bleaching or other treatment agents through bores formed in the pins under a pressure at least equal to the pressure in said grinding and bleaching zone.

14. A method as recited in claim 1 wherein said step of injecting is accomplished by passing said bleaching or other treatment agents through a longitudinal bore in said screw and radially outwardly through radial bores formed in said helical flights, said radial bores communicating at their outer ends with said grinding and bleaching zone.

15. A method as recited in claim 1 further including the step of applying pressure to said material in said material feed inlet to enhance the entry of said material into said hollow cylinder.

16. A method as recited in claim 1, further including the step of controlling the temperature of said screw in said pressure zone.

17. A method as recited in claim 12, further including the step of controlling the temperature of said cylinder in said pressure zone.

* * * * *